US008162032B2

(12) United States Patent
Arvedi

(10) Patent No.: US 8,162,032 B2
(45) Date of Patent: Apr. 24, 2012

(54) PROCESS AND PLANT FOR MANUFACTURING STEEL PLATES WITHOUT INTERRUPTION

(76) Inventor: Giovanni Arvedi, Cremona CR (IT)

( * ) Notice: Subject to any disclaimer, the term of this patent is extended or adjusted under 35 U.S.C. 154(b) by 394 days.

(21) Appl. No.: 11/988,334

(22) PCT Filed: Jul. 19, 2005

(86) PCT No.: PCT/IT2005/000412

§ 371 (c)(1),
(2), (4) Date: Jan. 4, 2008

(87) PCT Pub. No.: WO2007/010564

PCT Pub. Date: Jan. 25, 2007

(65) Prior Publication Data

US 2009/0159234 A1 Jun. 25, 2009

(51) Int. Cl.
*B22D 11/00* (2006.01)

(52) U.S. Cl. ..... 164/476; 164/417; 29/527.7

(58) Field of Classification Search ..... 164/476, 164/417; 29/527.7

See application file for complete search history.

(56) References Cited

U.S. PATENT DOCUMENTS

| | | | | |
|---|---|---|---|---|
| 3,710,436 | A | 1/1973 | Schoffmann | |
| 5,458,704 | A | 10/1995 | Bobbert et al. | |
| 5,657,814 | A | 8/1997 | Maebara et al. | |
| 5,810,069 | A | 9/1998 | Flick et al. | |
| 5,832,985 | A | 11/1998 | Pleschiutschnigg et al. | |
| 5,924,184 | A * | 7/1999 | Donini et al. | 29/527.7 |
| 6,092,586 | A | 7/2000 | Schönbeck | |
| 6,386,271 | B1 * | 5/2002 | Kawamoto et al. | 164/472 |
| 6,978,531 | B1 * | 12/2005 | Che et al. | 29/527.7 |
| 7,343,961 | B2 | 3/2008 | Arvedi | |
| 2005/0039320 | A1 | 2/2005 | Thomanek | |
| 2009/0056906 | A1 | 3/2009 | Arvedi | |

FOREIGN PATENT DOCUMENTS

| | | |
|---|---|---|
| CN | 1132670 A | 10/1996 |
| CN | 1161009 A | 10/1997 |
| CN | 1214642 A | 4/1999 |

(Continued)

OTHER PUBLICATIONS

Xiaoming, Zhang, et al., "Simulation of the Temperature Field during the Transporting Process of the Continuous Casted Slab Rolled Directly", *Journal of Northeastern University* (*Natural Science*),2001, vol. 22(1), pp. 99-101.

Communication from the Chinese foreign patent office Application No. 2005/0049993.0 on Sep. 7, 2010 with attached English language translation of the text of the Second Office Action, 8 pages.

Communication from the Chinese foreign patent office Application No. 2005/80049999.8 on Sep. 7, 2010 with attached English language translation of the text of the Second Office Action, 7 pages.

In the United States Patent and Trademark Office, Non-Final Office Action dated Sep. 20, 2010, U.S. Appl. No. 11/988,331, 10 pages.

*Primary Examiner* — Kuang Lin
(74) *Attorney, Agent, or Firm* — Flaster/Greenberg PC

(57) ABSTRACT

Process and related plant for manufacturing steel plates with thickness <100 mm and width of up to 4000 mm from a continuous casting step for slabs, comprising a liquid core reduction step, without interruptions until completion of a finishing rolling step with high reduction ratios in at least one stand. The average temperature when entering the rolling step is ≧1200° C., but can be reduced for unalloyed or low alloyed steel greatest.

10 Claims, 1 Drawing Sheet

FOREIGN PATENT DOCUMENTS

Figure 1:
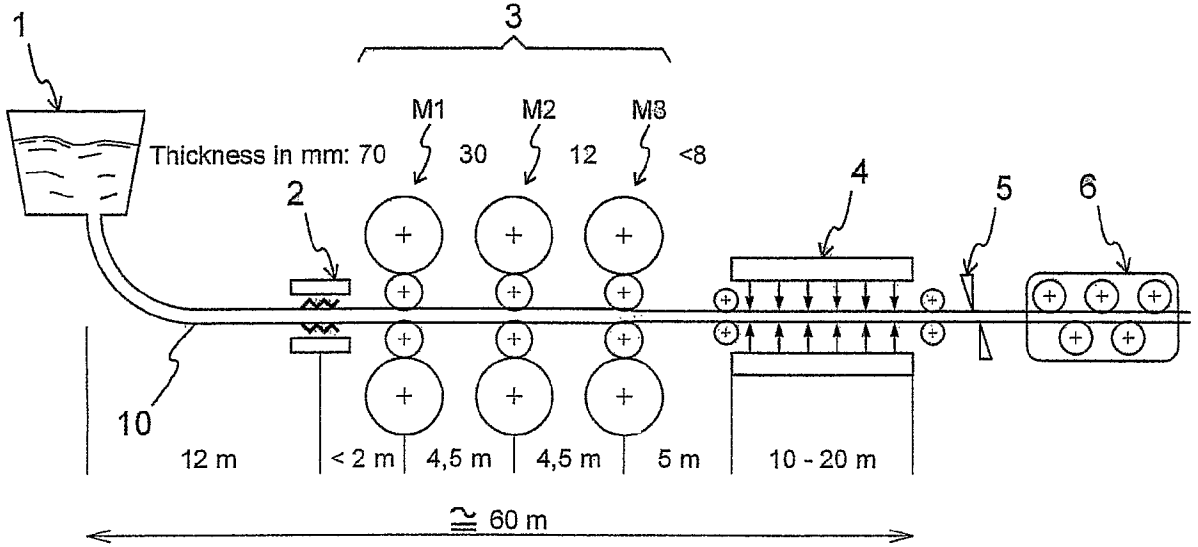

| | | | | |
|---|---|---|---|---|
| DE | 2019700 | A1 | | 11/1970 |
| EP | 0 327 854 | A2 | | 8/1989 |
| EP | 0 580 062 | B1 | | 1/1994 |
| EP | 0 611 610 | A1 | | 8/1994 |
| EP | 0 603 330 | B1 | | 6/1996 |
| EP | 0 730 916 | A1 | | 9/1996 |
| EP | 0 761 327 | A1 | | 3/1997 |
| EP | 0 925 132 | B1 | | 6/1999 |
| EP | 0 946 316 | B1 | | 10/1999 |
| EP | 1 011 896 | B2 | | 6/2000 |
| WO | WO 92/22389 | A1 | | 12/1992 |
| WO | WO 96/01710 | | * | 1/1996 |
| WO | WO 00/71272 | A1 | | 11/2000 |
| WO | WO 2004/026497 | A1 | | 4/2004 |

* cited by examiner

PROCESS AND PLANT FOR MANUFACTURING STEEL PLATES WITHOUT INTERRUPTION

BACKGROUND OF THE INVENTION

1. Field of the Invention

The present invention relates to a process and related plant for manufacturing steel plates without interruption from the continuous casting to the last rolling stand.

2. Description of Related Art

It is known that traditionally, in this field of manufacturing, "reversible" rolling stands have been generally used to roll, by means of several longitudinal and transversal passes, in order to increase each time the product size in length and width, an ingot, preferably of rectangular cross-section, or a slab suitably heated upstream in a heating and temperature equalization furnace, until obtaining a plate of desired thickness and width. The dimensions of the ingot or slab, the latter being possibly produced from continuous casting, are such to show a thickness between 120 and 400 mm and a width between 1000 and 2000 mm according to the type of steel and the technology employed for the manufacturing.

It is also known that in this type of processing the ratio between the thickness of the starting material, i.e. the ingot or slab, and of the desired final plate should not be less than 1:4 in order to ensure welding of possible pores present in the core or middle zone, which are typical in ingots/slabs of great thickness. This means, for a plate having final thickness of 50 mm, an initial slab with minimum thickness of 200 mm.

With the subsequent development of the thin-medium thickness slab technology, plants have been designed by which slabs with a thickness of up to 150 mm are cast, having a width of up to 3600 mm. These slabs are subsequently cut and, upon passing through a heating and temperature equalization furnace, are forwarded in line to a reversible rolling mill which however is adapted to longitudinally rolling only.

With these plants the thickness ratio between slab and final plate can be as low as 1:3, whereby a minimum slab thickness of 150 mm would be required for a plate 50 mm thick. Of course it is also possible with these plants to produce not only plates but also strips wound in coils by making the same reversible stand to work with two rails in a furnace ("plate/Steckel mill technology"). It is clear that with a reduction ratio 1:3 between slab and final plate, to obtain thicknesses of 40-50 mm for the finished plate it is necessary that slabs of 120-150 mm are cast at a maximum speed in the order of 2 m/min, that is insufficient for an in-line rolling process without interruption, requiring on the contrary a minimum speed of 3.5 m/min.

These considerations have prevented so far from adopting in the plate manufacturing the "cast-rolling" technology already known for manufacturing strips. From experimental tests, that however have not made possible to obtain reductions higher than 35% owing to the reduced torque value of the rolling stands, mathematic simulating models have been developed. It has been understood from these models that the same quality results can be reached with a reduction coefficients even greater than 50% and even up to 60%, bringing to more compact plants and further reducing the production costs and investments.

BRIEF SUMMARY OF THE INVENTION

Therefore it is an object of the present invention to provide a process and related plant for the manufacturing of plates with thickness of up to 100 mm and width up to 4000 mm, with low investment and production costs.

When adopting the technology employed for manufacturing coils according to patents EP 0925132, EP 0946316 and EP 1011896, all in the present applicant's name, it has been observed that, starting at the outlet of the mold with a product 75 mm thick and at the outlet of the continuous casting with a thickness of 55 mm, after a liquid core reduction ("soft reduction"), an average temperature higher than 1250° C. at a speed of 5 m/min was established. The in-line rolling was carried out with two stands having high reduction ratio (33% at the first stand and 30% at the second one) to obtain final plates 25 mm thick and consequently with a thickness ratio slab/plate of about 1:2. The quality was comparable to that of plates manufactured according to the prior art, in particular free from pores and provided with a homogeneous microstructure throughout the whole thickness.

The object of the present invention is thereby obtained with a process for manufacturing steel plate having a thickness <100 mm and a width up to 4000 mm, from a slab continuous casting step, wherein the method comprises a liquid core reduction step with a thickness ≧55 mm at the outlet, an average temperature ≧1250° C., without interruptions up to the end of a finishing rolling step with high reduction ratios, through one or more stands, followed by a cooling step and cutting at the desired length of the plate and relating plant for manufacturing steel plate having a thickness <100 mm and width up to 4000 mm, from a continuous casting product for slabs, casting mold, liquid core reduction means to obtain a thickness ≧55 mm at the outlet at an average temperature ≧1250° C., without interruptions until the last stand of a finishing rolling mill with one or more stands being in line with the said continuous casting under high reduction ratio, followed by cooling means and a shear for cutting the plate at a desired length.

BRIEF DESCRIPTION OF THE SEVERAL VIEWS OF THE DRAWING(S)

Figure 2:
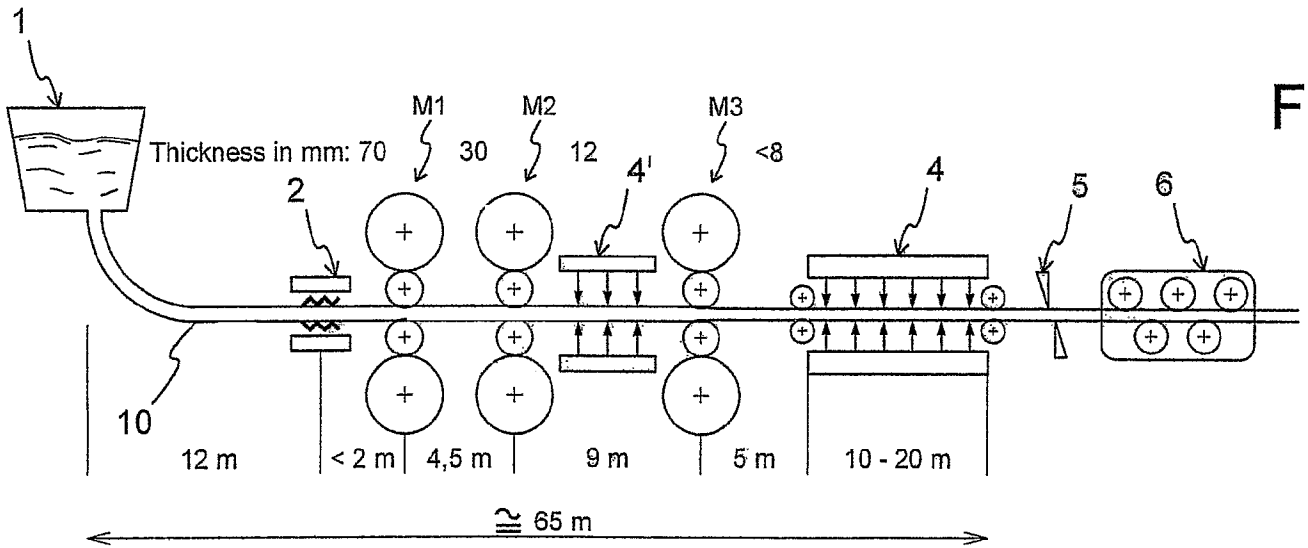

These and other objects, advantages and features of the present invention will be clearer from the following detailed description of two embodiments thereof, given by non-limiting example with reference to the annexed drawings. The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 1 shows a schematic view of a plant according to the present invention for manufacturing plates in stainless steel; and FIG. 2 shows a schematic view of a plant according to the present invention for manufacturing plates in unalloyed or low alloyed steel grade.

DETAILED DESCRIPTION OF THE INVENTION

With reference to FIG. 1 there is shown a plant on which the mutual distances are quoted between the various components of the plant with a whole distance, of about 60 m, between a continuous casting machine 1 and the end of rolling step. There are also shown thickness values, different from those mentioned in the example given above, but anyhow falling within the claimed range of values. Starting in fact with a thickness of 70 mm for a slab 10 from continuous casting 1 with a speed of 3.5 m/min and average temperature of 1250° C., there follows a descaler 2 and then, without interruptions, a rolling mill 3 placed in line with the casting machine 1 without solution of continuity until obtaining at the outlet a plate with a thickness even lower than 8 mm. According to the type of steel and desired thickness for the plate, the rolling stands being represented in number of three (M1-M3) can be reduced in number by omitting one or two thereof. Thanks in fact to the temperature conditions claimed it is possible to obtain the final plate even with only a single rolling stand and suitable reduction ratio comprised between 1:1.5 and 1:2.5, preferably of about 1:2.

It will be noted in fact that a favorable temperature profile for a thin slab, with a temperature value in the core or middle region that is rather high and near to 1350° C., increases the average rolling temperature and allows for a high thickness reduction, thus welding the inner pores with less rolling passes with respect to a conventional plate rolling mill. As a matter of fact, when exceeding a given reduction ratio or shape factor at constant width, the hydrostatic stress or specific pressure at the thin slab core reaches values which are high enough to weld any existing pores. Moreover the high deformation temperatures enhance recrystallization, i.e. the process by which the grain is deformed and then, thanks to the high temperature, recrystallizes completely, thus favorable the formation of uniform microstructures, contrary to what occurs when rolling at lower temperatures, e.g. from 1050 to 900° C. as taught by patent EP 0580062. These low temperatures generally give rise in fact to mixed structures that are not completely recrystallized.

High rolling temperatures also enhance in stainless steel the solubilization of chrome carbides, thus avoiding their precipitation without having to make recourse to subsequent specific solubilization treatments.

Referring again to FIG. 1, an accelerated cooling step then follows in 4, which allows a further improvement of the microstructures and characteristics of the plate profile.

Finally, after a shear 5 to cut the plate at the desired length, a straightening step 6 can be provided.

With reference to FIG. 2, another embodiment of the plant according to the present invention is instead represented, which is particularly adapted for plates in unalloyed or low alloyed steel. In this case, intermediate between the stands M2 and M3 there is provided an interstand cooling 4' capable of lowering by 50-100° C. the high rolling temperature, as it is required for these types of steel. In these cases it is in fact necessary to provide a thermo-mechanical rolling with a combined treatment of mechanical deformation and cooling.

The distance between M2 and M3 is greater as a consequence of the presence of an additional cooling system 4' between these two stands. There could be also provided, still in view of the above-mentioned thermo-mechanical treatment, as required for the unalloyed or low alloyed steel, a lower distance between the first stand M1 and the intensive cooling 4 on the outlet roller path.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A process for manufacturing steel plate having a thickness <100 mm and a width up to 4000 mm, from a slab obtained by a continuous casting step, the method comprising reducing a liquid core of the slab to a slab thickness ≧55 mm at the outlet, wherein the slab has an average temperature ≧1250° C., finishing rolling with high reduction ratios, through one or more stands without interruption up to the end of finishing rolling to form a plate, cooling the plate, and cutting the plate at a desired length, wherein a ratio between a thickness of a slab leaving the continuous casting step before reducing the liquid core and a final thickness of the steel plate after finishing rolling is between 1:1.5 and 1:2.5.

2. The process according to claim 1, further comprising a final straightening step.

3. The process according to claim 1, further comprising a descaling step upstream of the finishing rolling.

4. The process according to claim 1, wherein at the beginning of the rolling step a core temperature of a material to be rolled is about 1350° C.

5. The process according to claim 1, further comprising an additional intermediate cooling step between the rolling stands to reduce the rolling temperature by 50-100° C. when the steel is unalloyed or low alloyed steel requiring thermo-mechanical treatment.

6. A process for manufacturing steel plate having a thickness <100 mm and a width up to 4000 mm, from a slab obtained by continuous casting step, the method comprising reducing a liquid core of the slab to a slab thickness ≧55 mm at the outlet, wherein the slab has an average temperature ≧1250° C., finishing rolling with high reduction ratios, through not more than three stands without interruption up to the end of the finishing rolling to form a plate, cooling the plate, and cutting the plate at a desired length, wherein a ratio between a thickness of a slab leaving the continuous casting step before reducing the liquid core and a final thickness of the steel plate after finishing rolling is between 1:1.5 and 1:2.5.

7. The process according to claim 6, further comprising a final straightening step.

8. The process according to claim 6, further comprising a descaling step upstream of the finishing rolling.

9. The process according to claim 6, wherein at a beginning of the rolling step a core temperature of a material to be rolled is about 1350° C.

10. The process according to claim 6, further comprising an additional intermediate cooling step between the rolling stands to reduce the rolling temperature by 50-100° C. when the steel is unalloyed or low alloyed steel requiring thermo-mechanical treatment.

* * * * *